United States Patent [19]

Engel et al.

[11] Patent Number: 4,918,964

[45] Date of Patent: Apr. 24, 1990

[54] ADJUSTING MECHANISM FOR A UNIVERSAL STAND

[75] Inventors: Georg Engel, Kaarst; Ernst-August Häberer, Korschenbroich, both of Fed. Rep. of Germany

[73] Assignee: SMS Schloemann-Siemag Aktiengesellschaft

[21] Appl. No.: 146,952

[22] Filed: Jan. 22, 1988

[30] Foreign Application Priority Data

Jan. 23, 1987 [DE] Fed. Rep. of Germany ..... 3701889

[51] Int. Cl.[5] ..... B21B 13/10; B21B 37/08

[52] U.S. Cl. ..... 72/225; 72/20; 72/238

[58] Field of Search ..... 72/238, 225, 21, 20

[56] References Cited

U.S. PATENT DOCUMENTS

| | | | |
|---|---|---|---|
| 3,111,047 | 11/1963 | Metzger . | |
| 4,702,099 | 10/1987 | Sturm | 72/225 X |
| 4,787,226 | 11/1988 | Haynes | 72/225 X |

FOREIGN PATENT DOCUMENTS

| | | | |
|---|---|---|---|
| 1118724 | 12/1961 | Fed. Rep. of Germany | 72/225 |
| 0018287 | 4/1981 | Japan | 72/225 |
| 0127513 | 8/1982 | Japan | 72/225 |
| 212958 | 5/1968 | U.S.S.R. . | |
| 1217509 | 3/1986 | U.S.S.R. . | |

*Primary Examiner*—W. Donald Bray

*Attorney, Agent, or Firm*—Toren, McGeady & Associates

[57] ABSTRACT

An adjusting mechanism for a universal stand, particularly for a finishing stand in a group of compact roll stands and a method for operating the adjusting mechanism. The adjusting mechanism includes two hydraulic control cylinders for at least one horizontal roll which is usually the top roll. The at least one horizontal roll and the two vertical rolls are provided with hydraulic fine adjustments and each roll having a hydraulic fine adjustment is provided with an electromechanic coarse adjustment which can be operated independently of the fine adjustment. The electromechanic coarse adjustments as well as the hydraulic fine adjustments are monitored with respect to position of displacement pickups. The fine adjustments are additionally monitored by means of pressure pickups or rolling force pickups. The hydraulic fine adjustments are set up for the adjustment and opening of the rolls under pressure. All actual values measured with respect to position, pressure and/or rolling force can be stored and reproduced in an electronic control device. The hydraulic fine adjustments are controlled in accordance with displacement.

5 Claims, 1 Drawing Sheet

ADJUSTING MECHANISM FOR A UNIVERSAL STAND

BACKGROUND OF THE INVENTION

1. Field of the Invention

The present invention relates to an adjusting mechanism for a universal stand, particularly for a finishing stand in a group of compact roll stands. The adjusting mechanism includes two hydraulic control cylinders for at least one horizontal roll which is usually the top roll.

2. Description of the Prior Art

In a roll stand, a hydraulic adjustment of both horizontal rolls is recommended for maintaining the rolling axis. It is also known in the art that hydraulically controlled rolls can be combined with an electromechanical coarse adjustment, so that the control stroke in the cylinders is kept low because of the compressibility of the pressure oil.

When vertical rolls in universal stands are driven in a dragging operation by temporarily pressing the vertical rolls against the end faces of the horizontal rolls, i.e., not for control purposes, it is also known in the art from German Auslegeschrift No. 11 18 724 to combine hydraulic and electromechanic adjusting mechanisms.

The present invention particularly deals with the start-up of universal stands which conventionally is carried by means of test bars. It is possible to reproduce all adjustment data for the pass schedule of the program to be rolled. However, these data cannot be taken into consideration from bar to bar because of the blooming tolerances, temperature differences and changing quality of material to be rolled.

Therefore, it has been found necessary to adjust approximately the pass of a universal stand according to the respective pass schedule in a test run by means of one or more test bars for the finishing pass in accordance with the parameters which change during the respective pass, or to carry out the control of a pass adjustment by means of a test bar.

It is, therefore, the primary object of the present invention to provide an adjusting mechanism in which the pass adjustment of a universal stand, particularly a finishing stand, can be carried out without test run and test bars.

SUMMARY OF THE INVENTION

In accordance with the present invention, at least the one horizontal roll and the two vertical rolls are provided with a hydraulic fine adjustment and all rolls having a a hydraulic fine adjustment are each provided with an electromechanic coarse adjustment which can be operated independently of the fine adjustment. The electromechanic coarse adjustments as well as the hydraulic fine adjustments are monitored with respect to position by means of displacement pickups. The fine adjustments are additionally monitored by means of pressure pickups or rolling force pickups. The hydraulic fine adjustments are set up for the adjustment and opening of the rolls under pressure. All actual values measured with respect to position, pressure and/or rolling force can be stored and reproduced in an electronic control device. The hydraulic fine adjustments are controlled in accordance with displacement.

Thus, the combination according to the present invention of electromechanic coarse adjustments with hydraulic fine adjustments and the manner of controlling the operation of the adjusting mechanism according to the present invention make it possible, after an electromechanic coarse adjustment of the vertical rolls and at least one horizontal roll in accordance with the pass schedule, to carry out displacement-controlled hydraulic fine adjustments in dependence upon hydraulic pressures or roll forces which change in accordance with the sections and material to be rolled.

The desired positional values of the hydraulic fine adjustment are corrected in dependence upon the stand stiffness or stand resiliency characteristics and the measured rolling forces. The positions of the hydraulic fine adjustments are picked up by means of positioned displacement pickups and are hydraulically controlled to new desired values. Thus, not only the problems of a quick pass adjustment of a universal joint without test run by means of a test bar is solved, but it is additionally made possible that the pass adjustment which in the past had only been approximately correct by means of a test bar can now automatically be improved from bar to bar. Moreover, it is now possible to pick up precisely the changes in rolling force during the rolling of a bar which in the past had only been done generally, and to continuously control the roll gap during the passage of the bar through the rolls, so that all disadvantages of an uncontrolled stand are eliminated.

While the invention can be used advantageously in the roughing stand or stands of a universal beam rolling mill, the invention is primarily intended for finishing stands. Particularly, the invention is used for the reproducible, rolling program-dependent pass adjustment after the opening of a finishing pass for the ineffective passing of initial beams in a universal beam rolling mill with a finishing stand arranged following a group of reversing stands, in accordance with German patent No. 25 34 647. In this patent, this problem is not described as being solvable by means of modern control technology. Inasmuch as this solution has been found in accordance with the present invention, it is no longer necessary to laterally move out the universal finishing stand with unchanged pass adjustment and to turn the stand in to the line of stands, so that the duration of the rolling process is not prolonged by the lateral movement or lifting and lowering of the stand because only the rolls for the roughing passes have to be opened and are reproducibly adjusted for the finishing pass.

The pass adjustment of a universal stand with an adjusting mechanism with control device according to the present invention operates as follows.

When the control is taken to operation or for the later maintenance of the control in regular intervals, the rolls are moved together by means of the electromechanic coarse adjustment in the stand until roll kissing is reached or a defined roll gap is reached by means of gauging pieces. The stand and adjustment mechanism components located in the horizontal and vertical force pattern are subjected by means of the hydraulic fine adjustments by increasing the pressures in the adjusting cylinders to a pressure which corresponds in accordance with the pass schedule to an average theoretically to be expected rolling force.

The adjusted value of the electromechanic coarse adjustments is reproducible by displacement pickups. This gauging process is repeated at several different pressures in the fine adjusting cylinders. The resulting different position values of the fine adjustments result in horizontal and vertical stand resiliency characteristics which are electronically stored. The desired position values for the electromechanic coarse adjustments are stored separately for each pass schedule. The hydraulic pressures in the adjusting cylinders of the fine adjustments are reproducible by means of pressure pickups or rolling force pickups and are stored as zero values in accordance with the previously carried out gauging.

During rolling, the pressure deviations from the zero value due to rolling forces are measured in the hydraulic fine adjustments, and the desired values for the position control of the hydraulic fine adjustments are corrected in dependence upon the corresponding stand characteristics, so that changes of the stand resiliency which are due to the beam or materials being rolled are compensated. A hydraulic displacement control for each roll which is dependent upon the rolling force ensures that the desired and reproducible roll adjustment is maintained independently of changes in rolling force.

When the rolling program is changed or when new rolls are mounted in the stand, the desired adjusting values of the electromechanic coarse adjustments are corrected in accordance with the roll abrasion which has been carried out. The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there is illustrated and described preferred embodiment of the invention.

DETAILED DESCRIPTION OF THE INVENTION

Figure 1:
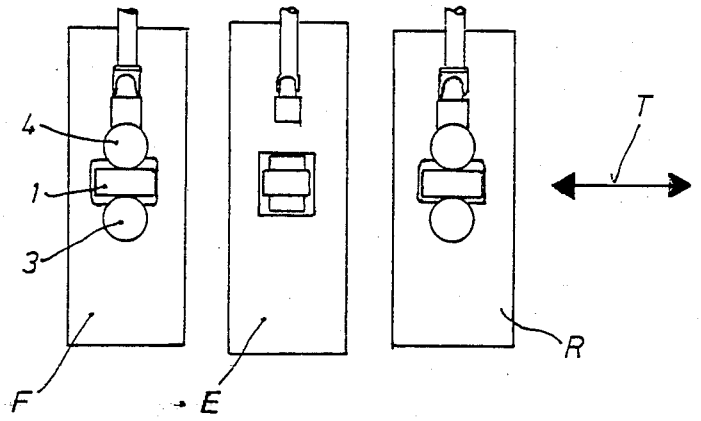
FIG. 1 is a schematic illustration of a universal beam rolling mill.

The universal beam rolling mill schematically illustrated in FIG. 1 includes two universal stands R and F and an edging stand E arranged between stands R and F. The three stands are arranged closely adjacent to each other and form a so-called group of compact universal roll stands. As indicated by double arrow T, the group of stands is operated in a reversing manner. Beams are rolled in the universal stand R and the edging stand E from an initial beam in several reversing passes. The finishing pass is carried out as the last pass in the universal finishing stand F. Until the finishing pass is carried out, the finishing pass formed by the rolls 1 through 4 of the finishing stand F is open for the ineffective passing of initial beams.

Figure 2:
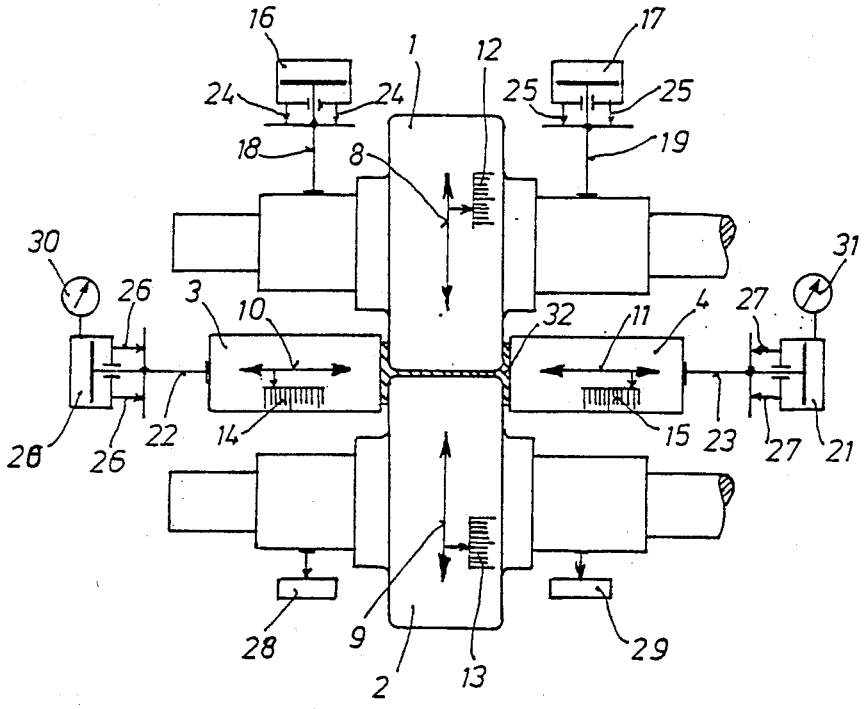
FIG. 2 is a schematic elevational view of a universal stand, the stand including rolls and the adjusting mechanism according to the present invention.

The adjusting mechanism in accordance with the present invention schematically illustrated in FIG. 2 of the drawing makes it possible to adjust the rolls quickly to the desired finishing pass without the requirement of determining the adjustment data for the finishing path by means of a test run with one or more test bars.

The schematic illustration of FIG. 2 shows two horizontal rolls 1 and 2 and the vertical rolls 3 and 4 of the universal finishing stand F of FIG. 2. The roll housing for receiving the rolling forces exerted by the rolls are not illustrated. In the illustrated embodiment, the upper horizontal roll 1 as well as the lower roll 2 each have an electromechanic coarse adjustment 8 and 9, respectively, symbolically illustrated by double arrows. These coarse adjustments are of a type which is known in the art. This is also true for the electromechanic coarse adjustments 10 and 11 for the vertical rolls 3 and 4, respectively.

The respective position of each horizontal roll 1, 2 is monitored by means of displacement pickups 12 and 13, respectively, which are indicated by scales. The positions of vertical rolls 3, 4 are monitored in the same manner by means of displacement pickups 14 and 15, respectively.

Two hydraulic control cylinders or fine adjustments 16 and 17 with pistons 18 and 19 are provided for the upper horizontal roll 1. Similarly, hydraulic fine adjustments 20 and 21 with pistons 22 and 23 are provided for the vertical rolls 3, 4. The positions of the pistons relative to the cylinders are monitored by means of two displacement pickups for each cylinder. Specifically, displacement pickups 24, 25 serve for monitoring the fine adjustments 16, 17, while displacement pickups 26, 27 monitor the fine adjustments 20 and 21.

The rolling force exerted by the horizontal rolls 1, 2 on the section being rolled is measured by means of rolling force pickups or pressure pickups 28 and 29. The rolling forces exerted by vertical rolls 3, 4 are determined by means of pressure pickups 30 and 31, respectively.

All actual displacement values, pressure values and rolling force values which are provided by pickups 12 through 15 and 24 through 31 can be stored and reproduced in an electronic control device, not illustrated in detail. Moreover, the hydraulic fine adjustments 16, 17, 20 and 21 are controlled with respect to displacement, i.e., the finishing stand F shown in FIG. 1 is connected to an automatic roll gap control for controlling the horizontal rolls as well as the vertical rolls.

The adjusting mechanism and the electronic control device, not shown, are operated as follows.

A gauging procedure must be carried out in certain intervals, particularly after grinding of the rolls. For this purpose, all rolls are moved toward each other until zero pass or roll kissing is reached. The rolls are moved by means of the electromechanic coarse adjustments 8 to 11. Subsequently, the average hydraulic pressures which are to be expected in accordance with the pass schedule are adjusted in the hydraulic fine adjustments 16, 17, so that the roll housings, not shown, are subjected to tensile stress and are spring loaded or expand. The deformations corresponding to the various hydraulic pressures are determined by means of the displacement pickups 24, 25 of the fine adjustments 16, 17, and the corresponding pressures or forces are registered by means of pressure pickups 28, 29.

All hydraulic pressures and vertical forces which have been stored and the resulting different position values of the fine adjustments 16, 17 from pressure-dependent deformations determine the stand resiliency characteristic for the vertical force pattern which is reproducibly stored in the electronic control device. In the same manner, the stand resiliency characteristic for the horizontal force pattern is determined by adjusting the hydraulic pressures in the fine adjustments 20, 21 for the vertical rolls 3, 4 to various average values to be expected in accordance with the pass schedule, such that the vertical rolls are increasingly pressed against the end faces of the horizontal rolls 1, 2. Consequently, the roll housing frames, not shown, are increasingly expanded for receiving the forces exerted by the vertical rolls. The pressure-dependent deformations are indicated by the displacement pickups 26, 27 and, together with the various values from the pressure pickups 30, 31, result in the stand resiliency characteristic for the horizontal pattern which is also reproducibly stored.

Subsequently, all position and pressure values adjusted under gauging conditions are fit at zero in accordance with automatic control technology, i.e., the values are adjusted to zero values in the electronic control device. After these gauging procedures have been concluded, the pass of the universal finishing stand F is opened by substantially moving back all rolls 1 through 4 by actuating the electromechanic coarse adjustments 8 to 11. The hydraulic pressures in the fine adjustments 16, 17 and 20, 21 are not applied. All changing values from the position and pressure pickups are introduced as actual values into the electronic control device. It is part of the preparation of a rolling program to reproducibly introduce into the control device the pass schedule-dependent desired position values for the electromechanic coarse adjustments and the pass schedule-dependent hydraulic pressures and displacement.

The rolling operation is carried out by rolling in a reversing operation an initial beam or unfinished beam in the two stands R and E of the group of compact universal stands illustrated in FIG. 1. During this operation, the finishing pass in the finishing stand F is opened wide for the ineffective passing of material to be rolled. When the finishing pass is to be carried out, the data which are relevant with respect to the roll adjustment according to the pass schedule are reproduced or called up from the electronic control devices, so that the rolls 1 through 4 are electromechanically and hydraulically adjusted to the desired finishing pass.

After the initial pass of the material being rolled, the preadjusted desired values coincide with the adjusted actual values to such an extent that a finished product can be expected which is as much within the tolerances as exactly the desired values could be preset in accordance with the pass schedule. However, the adjusting mechanism according to the present invention also takes into consideration blooming tolerances, temperature differences and changing quality of material being rolled. This is done by measuring during the finishing pass any deviations from the zero values of the hydraulic pressures, determining in the control device the appropriate changes of the spring loading of the stand in accordance with the stored stand resiliency characteristic and using the changed spring loading of the stand for correcting the position zero value of the hydraulic fine adjustments 16, 17 or 20, 21. By means of this corrected desired value, the desired reproducible roll adjustment is maintained independently of the rolling force changes by means of a hydraulic displacement control of the rolls 1, 3 and 4.

If the finishing pass is to be adjusted quickly for carrying out the finishing pass after the last ineffective passing of the material being rolled through the universal finishing stand F, it may be that a substantial time is required until the electromechanic coarse adjustments, which conventionally consist of threaded spindles and nuts, have been moved the necessary distance. Accordingly, it may be provided that the electromechanic coarse adjustments are successively actuated for closing the previously open finishing pass already during the reversing pass in the group of reversing stands R, E. The adjusting mechanism according to the invention can also be used in universal stands which do not carry out the finishing pass. Since given pass schedules can be realized with more accuracy, the number of required passes can be reduced and the production can be increased.

While a specific embodiment of the invention has been shown and described in detail to illustrate the application of the inventive principles, it will be understood that the invention may be embodied otherwise without departing from such principles.

We claim:

1. In a universal stand including horizontal rolls and vertical rolls and an adjusting mechanism, wherein the horizontal rolls and the vertical rolls are adjustable by means of combined electromechanic coarse adjustments and hydraulic fine adjustments, the electromechanic coarse adjustment as well as the hydraulic fine adjustment being monitored with respect to position by means of displacement pickups, the improvement comprising (a) the hydraulic fine adjustments being additionally monitored by means of pressure pickups or rolling force pickups, the hydraulic fine adjustments being operated for the adjustment and opening of the rolls under pressure, and the hydraulic fine adjustments being controlled in accordance with displacement, and (b) an electronic control device for storing and reproducing all actual values measured by the pickups with respect to position, pressure and rolling force.

2. The universal stand according to claim 1, wherein the fine adjustments are arranged following the coarse adjustments.

3. The universal stand according to claim 1, wherein the adjusting mechanism is mounted in a universal finishing stand following directly behind a group of compact universal stands, for opening widely and quickly the finishing pass for an ineffective passing of initial beams by means of the electromechanic coarse adjustments, and for subsequently adjusting the finishing pass for carrying out a finishing pass.

4. The universal stand according to claim 3, wherein, for closing the initially open finishing pass, the electromechanic coarse adjustments can be actuated successively during the carrying out of reversing passes in the group of stands.

5. A method of operating a universal stand including an adjusting mechanism and a control device, the universal stand including horizontal rolls and vertical rolls, wherein the adjusting mechanism includes two hydraulic control cylinders for at least one of the horizontal rolls, the at least one horizontal roll and the two vertical rolls being provided with a hydraulic fine adjustment each and all rolls having a hydraulic fine adjustment are provided with an electromechanic coarse adjustment which can be operated independently of the fine adjustment, the electromechanic coarse adjustments as well as the fine adjustments being monitored with respect to position by means of displacement pickups, the fine adjustments being additionally monitored by means of pressure pickups or rolling force pickups, comprising (a) carrying out a gauging procedure with the rolls being moved together in a roll kissing position, the gauging procedure including determining and electronically storing in an electronic control device stand resiliency characteristics for horizontal force patterns as well as vertical force patterns resulting from pressure-dependent formations after having adjusted average hydraulic pressures to be expected in accordance with a pass schedule and from resulting position values of the fine adjustments, and setting at zero in accordance with automatic control technology all position values and pressure values resulting under gauging conditions, (b) following the gauging procedure, reproducibly storing desired position values in accordance with the pass schedule for the electromechanic coarse adjustments and hydraulic pressures and displacements in accordance with the pass schedule, (c) prior to each initial roll of material, reproducing the data relevant for the roll adjustment in accordance with the pass schedule, whereby the rolls are electromechanically and hydraulically adjusted to the desired pass, and (d) during rolling, measuring deviations from the zero values of the hydraulic pressures, determining in the control device the appropriate range of the spring loading of the stand in accordance with the stored resiliency characteristic, and using the changed spring loading of the stand for correcting the zero position value of the hydraulic fine adjustments, and subsequently keeping constant this letter value as the desired value by means of hydraulic displacement control.

* * * * *